United States Patent [19]

Hollingsworth et al.

[11] Patent Number: 4,813,104

[45] Date of Patent: Mar. 21, 1989

[54] INTEGRATED COMPACT TEXTILE CARDING APPARATUS FRAME

[75] Inventors: John D. Hollingsworth, Greenville; Horst S. Selent, Greer; Gary F. Keener, Greenwood, all of S.C.

[73] Assignee: John D. Hollingsworth on Wheels, Inc., Greenville, S.C. ; a part interest

[21] Appl. No.: 107,689

[22] Filed: Oct. 9, 1987

[51] Int. Cl.[4] ..... D01G 15/40

[52] U.S. Cl. ..... 19/98; 19/10 S; 19/159 R

[58] Field of Search ..... 19/10 S, 159 R, 98

[56] References Cited

U.S. PATENT DOCUMENTS

| | | | |
|---|---|---|---|
| 4,277 | 11/1845 | Tatham et al. | 19/159 R |
| 1,503,094 | 7/1924 | Cramer | 19/159 R |
| 3,081,499 | 3/1963 | Goldman | 19/102 X |
| 4,286,357 | 9/1981 | Harrison | 19/104 X |
| 4,449,272 | 5/1984 | Cash | 19/159 R |
| 4,476,611 | 10/1984 | Keller et al. | 19/105 |
| 4,510,647 | 4/1985 | Keller et al. | 19/105 |

*Primary Examiner*—Louis K. Rimrodt

*Attorney, Agent, or Firm*—Cort Flint

[57] ABSTRACT

A compact textile carding frame and apparatus is disclosed which includes a carding machine (A) having a frame (D) which supports the carding machine in a self-standing manner with vertical carding cylinders. Cantilevered support arms (114, 116) carry the fiber feed and doffing devices. A fiber feed chute (C) is carried on a chute frame (E) having longitudinal members (130, 130*a*) which telescope into horizontal tracks (72, 72*a*) of carding frame (D). The precise working position of feed chute (C) and carding machine (A) may be fixed by their relative horizontal spacing. A coiler (B) is carried on a coiler frame (F) which pivots about a pivot (176) in and out of a precise working position with carding machine (A). An alignment and locking member (194) aligns the coiler upon return pivotal movement into the working position. The chute feed and coiler may be moved away from the carding machine and returned to their working positions while remaining connected permitting free access to both working sides of the carding machine and the associated chute feed and coiler.

39 Claims, 7 Drawing Sheets

INTEGRATED COMPACT TEXTILE CARDING APPARATUS FRAME

BACKGROUND OF THE INVENTION

The invention relates to textile carding apparatus and particularly to integrated compact frame arrangements for a vertical chute feed, carding machine, and coiler in which the associated textile machines may be interconnected and moved relative to each other while remaining connected. In the textile carding process, textile fibers are typically delivered to a vertical chute feed. The vertical chute feed delivers a compacted fibrous batt to a carding machine which cards the fibers and produces a carded web. The carded web may be condensed into a sliver and taken by a coiler which deposits the sliver into a coiler can. The vertical chute feed, carding machine, and coiler, by their working relationships, are disposed immediately adjacent each other. Often, as is necessary for access and working on each individual machine, the machines must be moved relative to each other. The typical carding machine has included a rather lengthy horizontal arrangement of rows and cylinders including the infeed and doffing of the carding cylinder. The invention is concerned with a new arrangement of a carding machine where plural carding cylinders are arranged in an upstanding manner and on a frame which is generally self-standing. The upstanding arrangement of carding cylinders provides for increased carding in a reduced space. Further, with the carding cylinders arranged vertically, more of the surface of the carding cylinders is exposed for working, carding, and access. This arrangement for a carding machine also enables the vertical chute feed and coiler to be spaced more closely to the carding machine.

Vertical arrangements of carding cylinders are known, for example, in U.S. Pat. No. 3,081,499. The carding cylinders and various specialty rolls are arranged in a somewhat different manner and are supported on a frame which consists of side plates. While the vertical arrangement does reduce space, no associated framing is provided for the chute feed or coiler, or the associated specialty rolls, which gives access and automatic realignment.

Accordingly, an important object of the present invention is to provide an integrated compact frame arrangement for a vertical chute feed, carding machine, and coiler which is simple and allows for the various machines to be moved relative to each other and realigned.

Still another object of the present invention is to provide a compact arrangement for a carding machine having clothed carding cylinders arranged generally vertical which reduces floor space and allows access to the working parts of the machine.

Still another object of the invention is to provide a compact carding machine having vertically arranged carding cylinders arranged in a self-standing manner and associated framing for interconnecting vertical chute feed and coiler so that the machines are aligned in working relationship and may be moved and returned without disturbing the working relationship.

SUMMARY OF THE INVENTION

Textile carding apparatus of the type which includes a carding machine having a first carding cylinder assembly and a second carding cylinder assembly with respective first and second clothed carding cylinders arranged in fiber transfer relation is disclosed. A fiber feed feeds fibers to a first cylinder and fiber doffer removes fibers from a second cylinder and forms a web. The web may be condensed into a sliver, which is deposited in a textile coiler. Integrated frame apparatus is provided which comprises carding frame for carrying the first and second carding cylinders in a generally upstanding arrangement one above the other. A chute frame carries a fiber feed chute in a fiber supply relation to the fiber feed of the carding machine. A coiler frame carries a textile coiler in alignment with the carding machine for depositing a sliver in a coiler can. Chute connecting means connects the chute frame to the carding frame in a movable manner so that the feed chute may be moved away from the carding machine while remaining connected to the carding frame for access to a first side of a carding machine. Coiler connecting means connects a coiler frame to the carding frame in an aligned movable manner. The coiler may be moved away from the carding machine while remaining connected to permit access to a second opposite side of a carding machine and coiler. The coiler may be returned to an aligned and locked position where the coiler is in alignment for receiving and depositing sliver from a carding machine.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
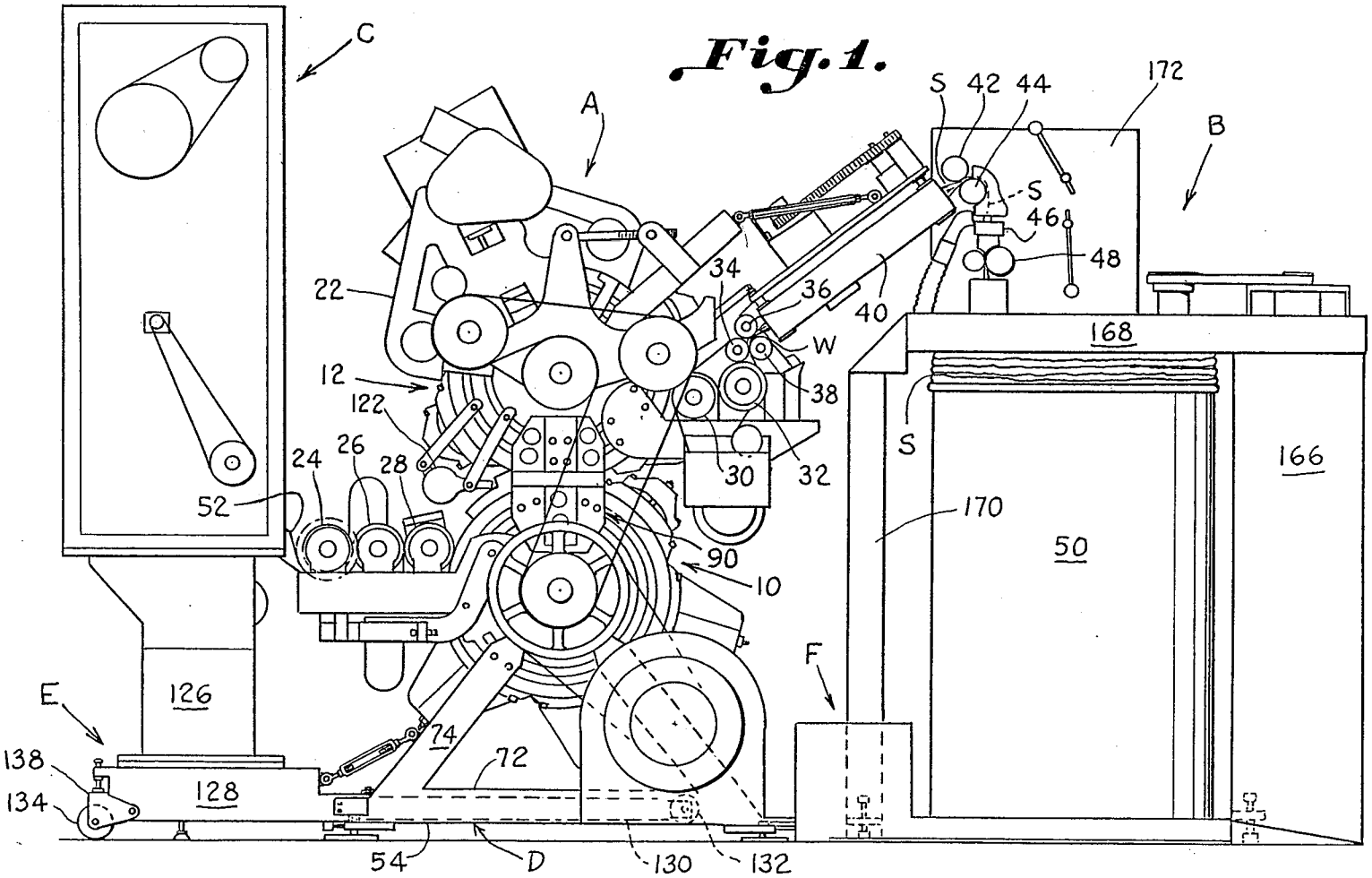
FIG. 1 is an elevation of compact carding apparatus and frame arrangements structured according to the invention.

Referring now in more detail to the drawings, compact textile carding apparatus and integrated frame will be described. As can best be seen in FIG. 2, there is a carding machine, designated generally as A, having a first carding cylinder assembly 10 and a second carding cylinder assembly 12. As can best be seen in FIGS. 6 and 7, first carding cylinder assembly 10 includes a clothed carding cylinder 14, and second cylinder assembly 12 includes a second clothed carding cylinder 16. Carding means for carding fibers on cylinder 14 include a plurality of stationary carding plates 18 for coarse carding of the fiber and fine carding plates 20 for finer carding of the fiber. These may be any suitable carding plates such as disclosed in U.S. Pat. Nos. 3,604,062 and 4,286,357. Carding means about the circumference of cylinder 16 includes stationary carding plates 20 for fine carding. An assembly 22 of revolving carding flats may be carried atop cylinder 12 or additional stationary carding plates may be used. As can best be seen in FIG. 1, fiber feed means for feeding fibers to cylinder 14 includes a fiber feed roll 24, a licker-in roll 26, and a transfer or redirect roll 28. Redirect roll 28 transfers fibers directly onto cylinder 14. Means for doffing the fibers from cylinder 16 includes a doffing roll 30, stripper roll 32, knurled redirect roll 34, and a pair of smooth delivery rolls 36 and 38. A web W delivered through delivery rolls 36 and 38 is collected and condensed into a sliver S by a pair of traveling belts 40. Silver S is delivered through a roller nip of transfer belts 40. It is to be understood, of course, that the compact frame arrangement of the present invention may be used with any carding arrangement, preferably having two vertically arranged cylinders, although a single cylinder may be used, in combination with different infeed, carding, and doffing arrangements. Fibers are transferred directly from cylinder 14 onto 16.

A textile coiler, designated generally as B, is positioned in a related working position to the carding machine A. Coiler B includes a pair of transfer rollers 42 and 44 which receive sliver S. The sliver is delivered downwardly through a trumpet 46 to a pair of calendar rolls 48 through a conventional coiler tube (not shown) into a coiler can 50. Any conventional textile coiler may be used to deliver the sliver into coiler can 50 in a well known manner. Positioned on an opposite side of carding machine A is a textile fiber chute feed, designated generally as C. Fibers are fed to chute feed C in a conventional manner. The chute feed compacts the fibers into a fibrous batt 52 which is delivered to feed roll 24. Chute feed C may be any conventional chute feed such as that disclosed in U.S. Pat. No. 4,476,611.

Figure 8:
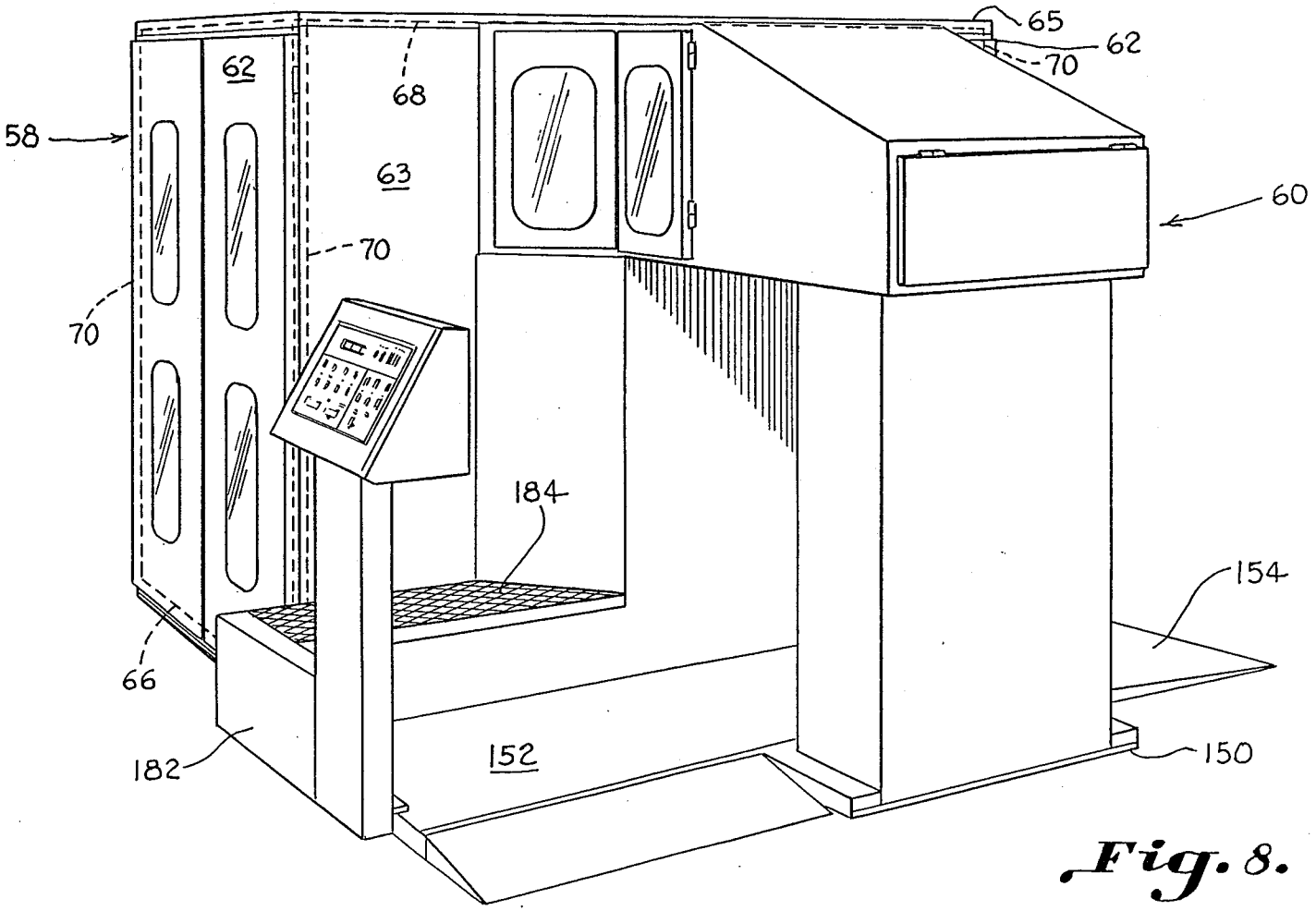
FIG. 8 is a perspective view illustrating a housing for a compact carding apparatus and frame of the invention.

Integrated carding frame means, designated generally as D, includes a carding frame, designated generally as 54, which carries the carding cylinder assemblies 10 and 12. The carding frame means further includes a box frame, designated generally as 56, which holds panels that form an enclosure housing, designated generally as 58, for carding machine A, as can best be seen in FIGS. 4, 5, and 8. There is a housing, designated generally as 60, for coiler B. Housing 58 includes side panels 62, front panels 63, rear panels 64, and top panel 65. Box frame 56 includes four horizontal bottom legs 66, four horizontal top legs 68, and four vertical legs 70 which may be a tubular steel.

A chute frame, designated generally as E, carries chute feed C in a fiber supply relation to fiber feed roll 24. A coiler frame, designated generally as F, carries coiler B in alignment with the carding machine for receiving and depositing sliver S in coiler can 50.

Figure 3:
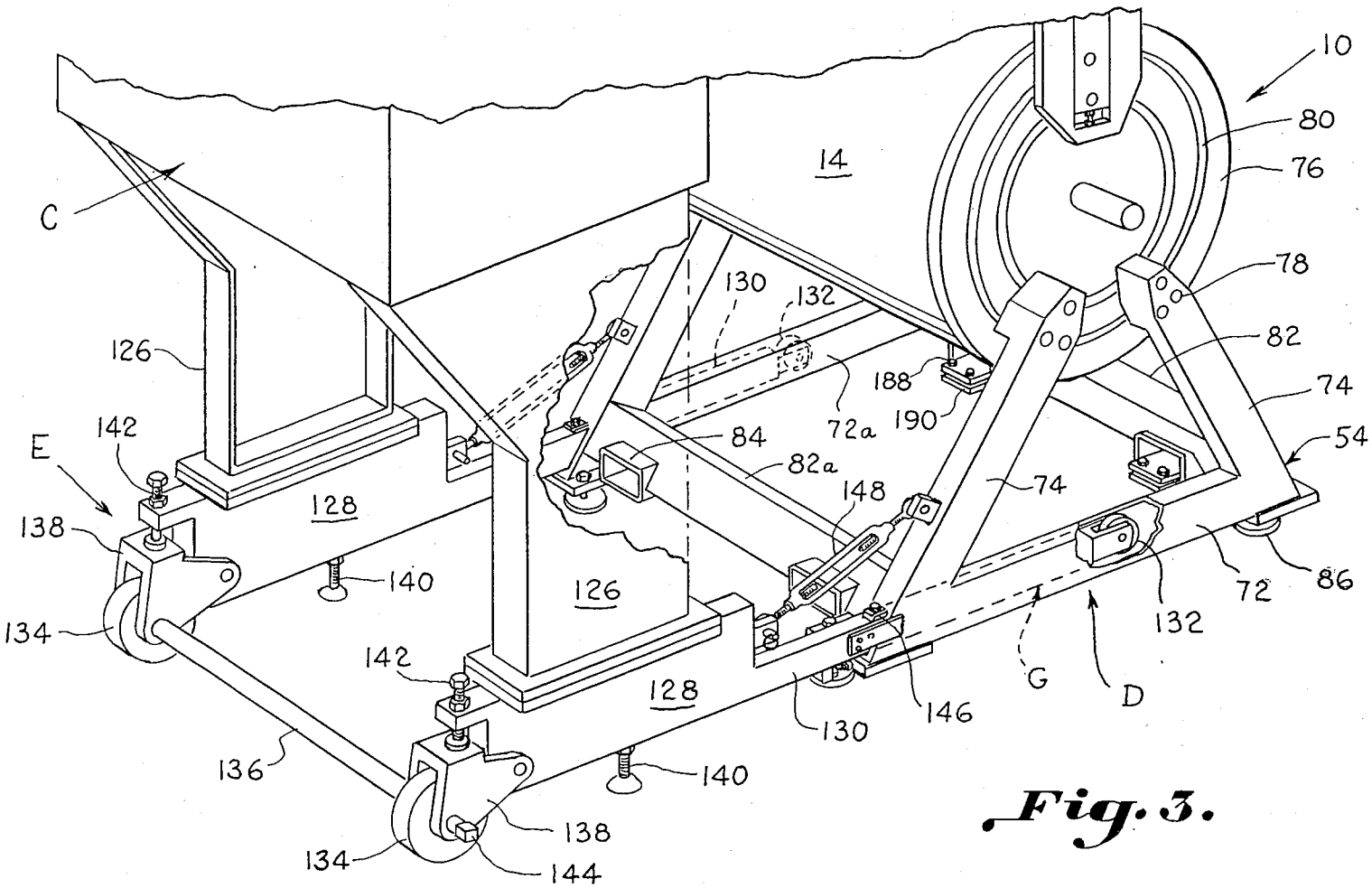
FIG. 3 is a perspective view illustrating a compact interconnecting frame arrangement for a vertical chute feed and carding machine according to the invention.

As can best be seen in FIG. 3, chute connecting means, designated generally as G, connects chute frame E to carding frame 54 in a movable manner so that the chute frame and feed chute may be moved away from carding machine A while remaining connected to the carding frame. This permits access to a first side of the carding machine and to chute feed C.

Figure 4:
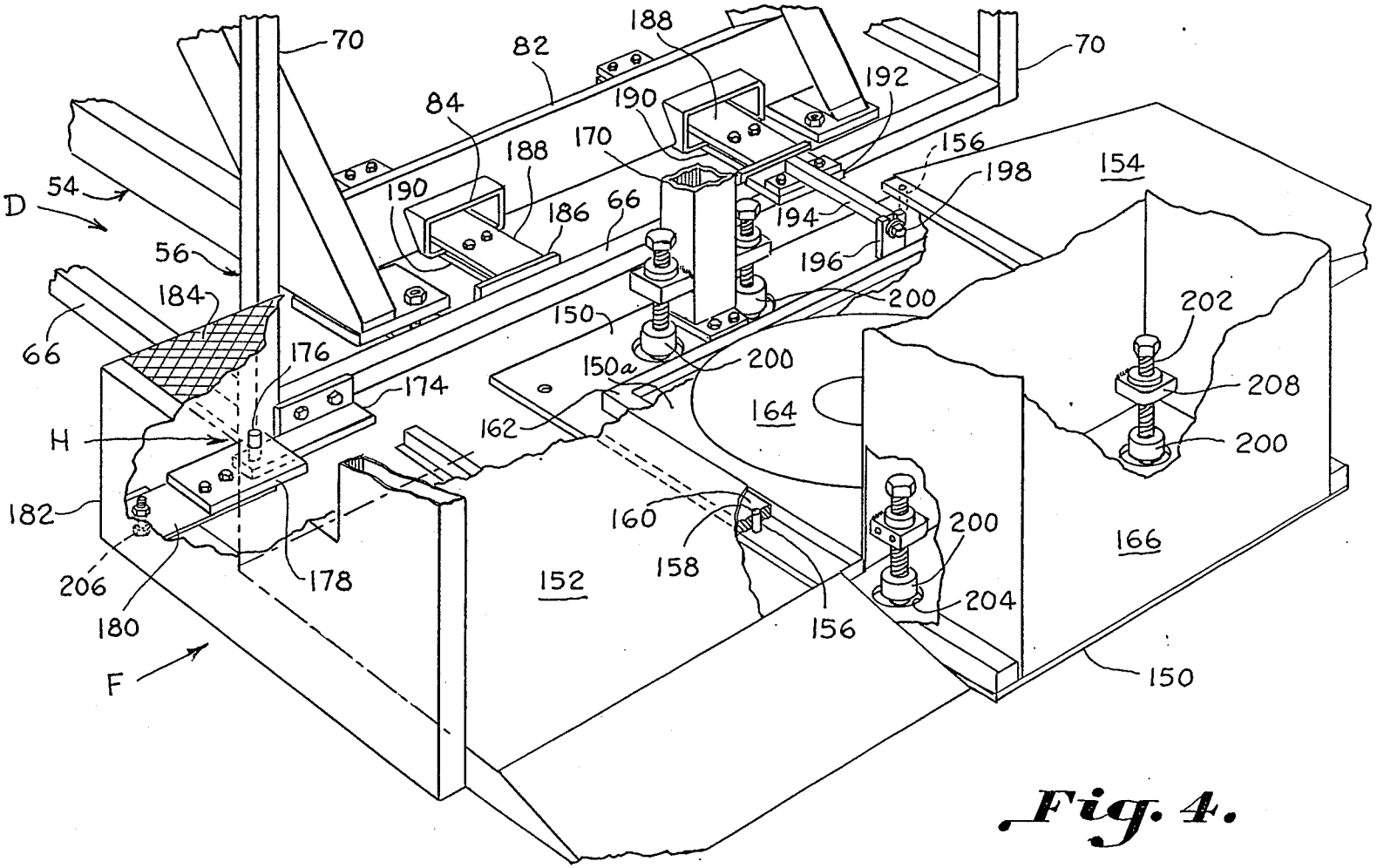
FIG. 4 is a perspective view illustrating a compact frame arrangement for a carding machine and coiler according to the invention.

As can best be seen in FIG. 4, a coiler connecting means, designated generally as H, connects coiler frame F to carding frame 54 in an aligned movable manner so that coiler B may be moved away from carding machine A while remaining connected to the carding machine to permit access to a second side of the carding machine and coiler B. Coiler B may be returned to an aligned position where the coiler is in alignment for receiving and depositing sliver S from carding machine A.

Figure 2:
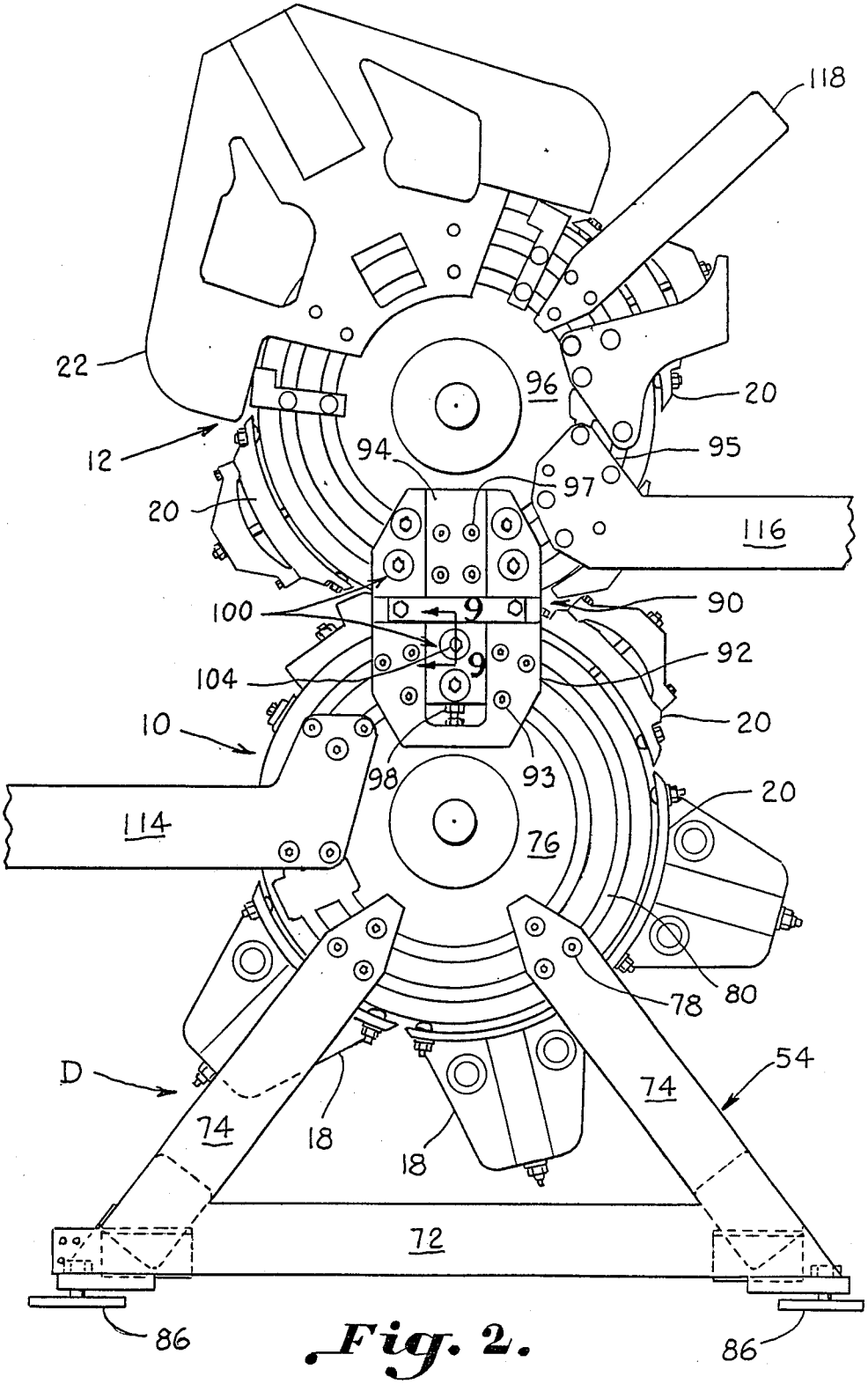
FIG. 2 is a side elevation of a compact carding machine arrangement and frame according to the invention.

As can best be seen in FIG. 2, carding frame 54 includes a pair of spaced horizontal legs 72 and a pair of standards 74 converging upwards from affixed positions on legs 72. The free ends of standards 74 are attached to end shrouds 76, **76*a* of first cylinder assembly 10. This is done by means of bolts 78 fastened into "T" grooves 80 formed in shrouds. Identical standards 74*a* extend up from horizontal leg 72*a* to attach to opposing end shroud 76*a*. Extending between opposing standards and horizontal legs are a pair of beams 82 and 82*a*. Forklift openings 84 are formed in each beam. A plurality of adjustable foot rests 86 are provided adjacent the four corners of frame 54 for supporting the frame above a support surface. Frame 54 serves as a base for a unique frame arrangement which provides for supporting cylinder assemblies 10, 12** in a self-supporting manner.

Figures 5, 9:
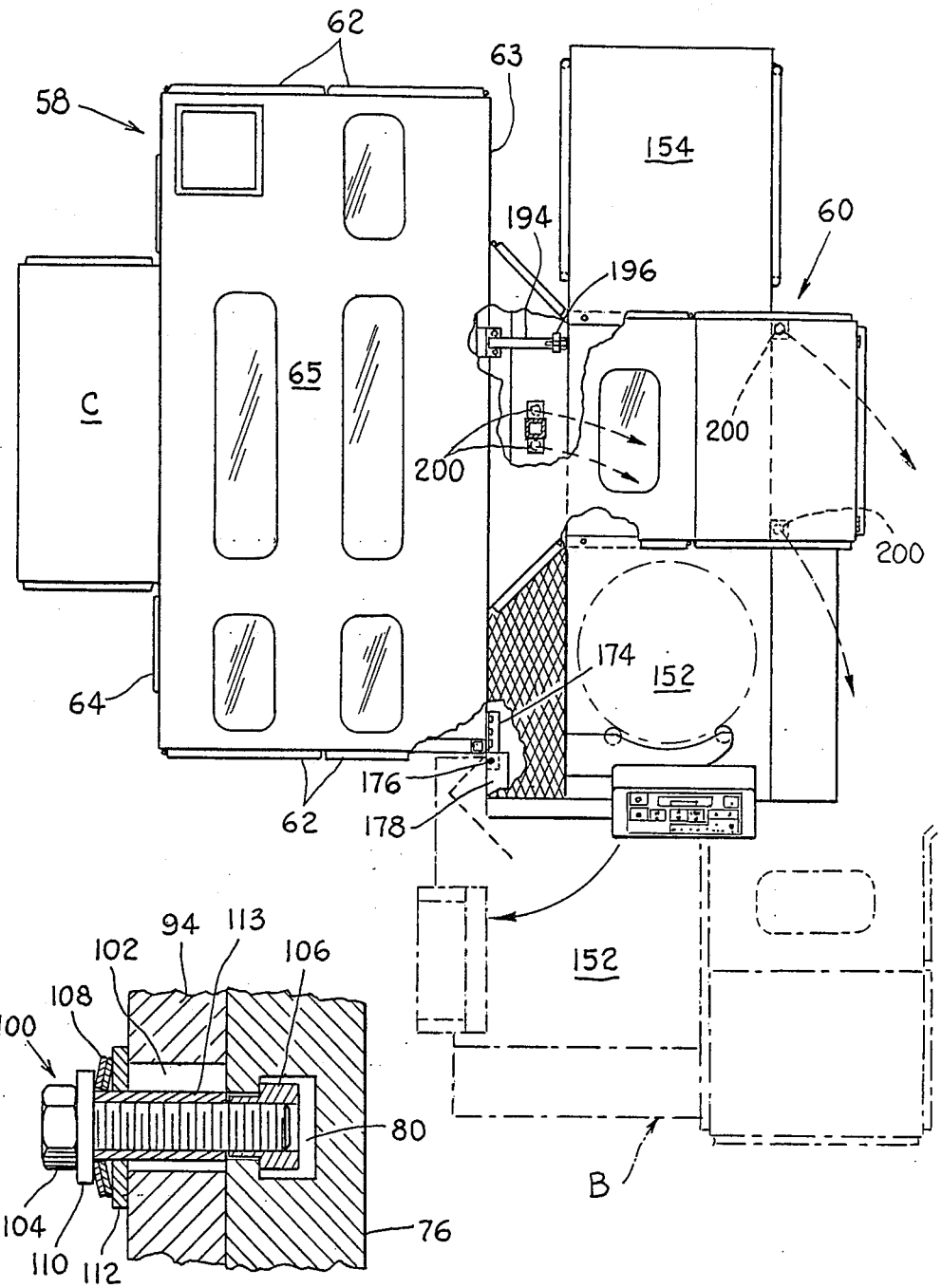
FIG. 5 is a top plan view of the compact carding and frame apparatus according to the invention.
FIG. 9 is a sectional view illustrating yieldable attachments for mounting the carding cylinders in a vertical frame arrangement according to the invention.

Mounting means, designated generally as 90, for mounting cylinder assembly 12 atop cylinder assembly 10 can best be seen in FIGS. 2 and 9. Mounting means 90 includes first plates 92 rigidly attached to shrouds 76 and **76*a* by bolts 93, and second plates 94 rigidly attached to shrouds 96 and 96*a* of cylinder assembly 12 by bolts 97. Plates 92 are yieldably attached to shrouds 96, 96*a* and plates 94 are yieldably attached to shrouds 76, 76*a*. A set member in the form of an adjustable nut 98 limits the downward motion of plates 94 which may move vertically relative to plate 92. Nut 98 provides a means for setting the clearance between the cylinders 14 and 16. This feature of mounting means 90 allows upper cylinder assembly 12 to move radially outward with respect to assembly 10. This protects the surface of cylinders 14 and 16 against crushing should a lump, or other large mass be passed between the cylinders. For this purpose, there are provided a plurality of movable or yieldable attachments 100 which fasten plates 92 and 94 to the "T" grooves of the respective end shrouds but yield for relative vertical movement between the plate and its attached shroud. As can best be seen in FIG. 9, there is a vertical space 102 formed in the attachment opening of each attachment 100. A bolt 104 is inserted through space 102 and threaded into "T" groove 80 by a nut 106. There is a Belleville washer 108 between a pair of washers 110 and 112. This Belleville washer allows bolt 104 to be tightened sufficiently to hold plate 94 to the shroud 76. At the same time, the tightened bolt and washer arrangement will yield and allow either plate 92 or 94 attached by yieldable attachments 100 to slide vertically to release forces accompanying passes of a large lump between the nip of cylinders 14 and 16**. The entire carding machine may be self-standing.

Figure 6:
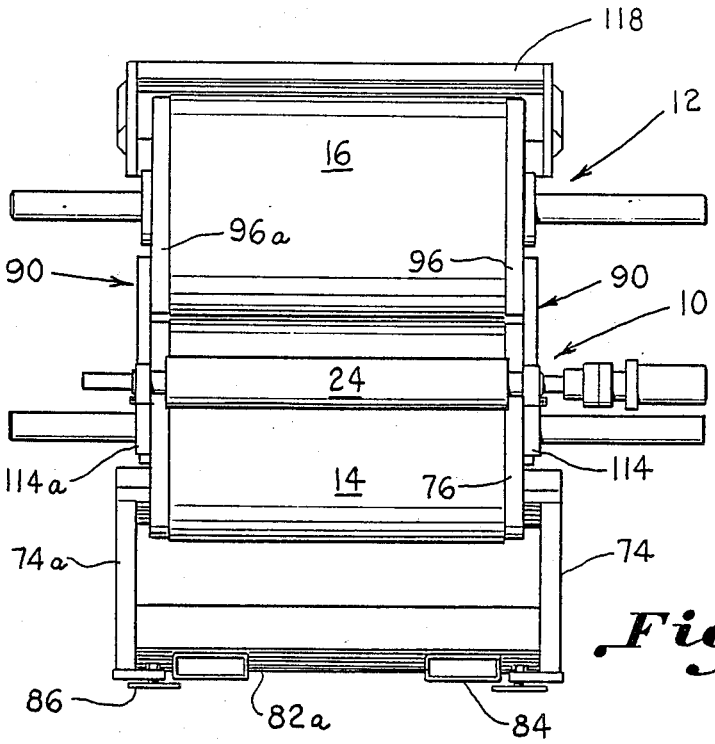
FIG. 6 is a rear elevation of a compact carding machine and frame according to the invention.
Figure 7:
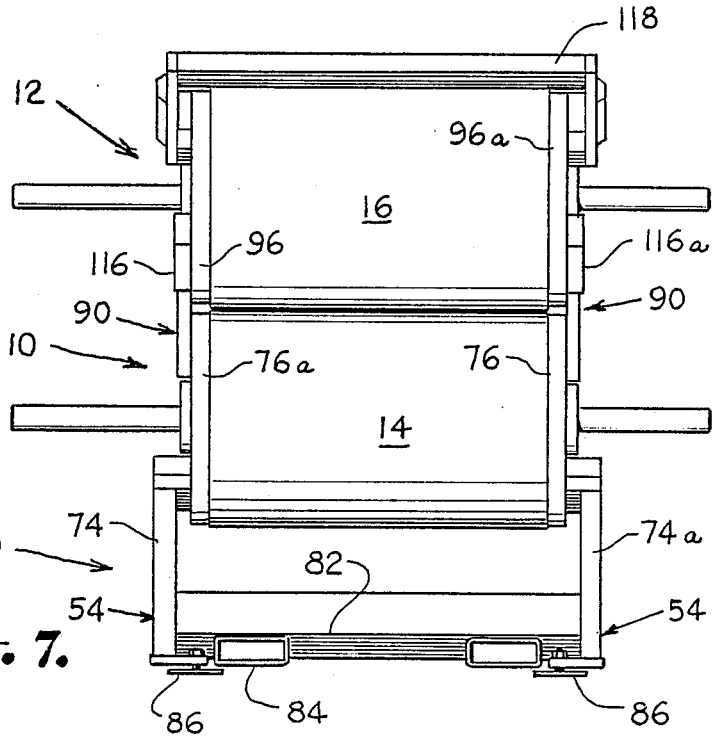
FIG. 7 is a front elevation of a compact carding machine and frame according to the invention.

As can best be seen in FIGS. 2, 6, and 7 a pair of cantilevered support arms 114 may support the fiber feed means which includes rolls 24, 26, and 28 rotatably mounted to the arms on suitable bearings. A pair of cantilevered support arms 116 may support the fiber doffing means consisting of the various rolls 30–36 and bearings. A girth beam 118 is attached to shrouds 96, 96a of cylinder assembly 12 to hold the assembly of shrouds and cylinder together. Arms 114, 114a, 116, and 116a may be attached to the end shrouds by bolts 120. The various other attachments and mechanical features of the card may be supported off of the end shrouds. For example, suction device 122 may be held by braces mounted to the shrouds. Revolving assembly 22 is attached by bolting into "T" grooves 95 of shrouds 96, 96a. Carding plates 18 and 20 may be attached directly to the respective end shrouds in a well known manner as disclosed in U.S. Pat. No. 4,286,357. The various other mechanical attachments of the peripheral elements needed to complete the carding apparatus may be attached as illustrated.

As can best be seen in FIG. 3, chute frame E is carried on legs 126 supported on spaced side frames 128. the side frames include longitudinal members 130 which are received in a telescoping manner within horizontal legs 72, 72a of card frame 54 which are tubular and hollow. Horizontal legs 72, 72a provide a track means for guiding chute frame E towards and away from carding machine A. The track means includes horizontal legs 72, 72a which serve as guide rails and legs 130, 130a which serve as guide members having rollers 132 which roll within the guide rails. On a backside of chute frame E are chute rollers 134 affixed to a shaft 136 which is rotatably held by a pair of brackets 138. Brackets 138 are adjustable in a vertical direction so that rollers 134 may be extended or retracted. When extended, the chute frame E may roll toward and away from the carding machine on rollers 134 and 132. When retracted, chute frame E rests on foot rest 140. Threaded rods 142 provide for extending and retracting the chute rollers. It will be noted that there is a drive means provided for rotating chute rollers 134 to slowly urge the chute frame in and out for adjustment relative to carding machine A. This drive means comprises a drive end 144 on roller shaft 136. This drive end is shaped so that it may be received in a socket of a conventional socket type ratchet wrench. In this manner, the wrench may be placed on the drive end 144 and rollers 134 may be ratcheted in slow increments in and out to finely position the chute feed C. When in a desired position, chute feed C may be locked with respect to carding machine A by locking means in the form of clamps 146. Adjustable turn buckles 148 also provide for adjusting the position of the chute feed and carding machine once they are in a certain proximity of each other.

As can best be seen in FIGS. 4 and 5, coiler frame F and coiler connecting means H for pivoting coiler B are illustrated and will be described. There is a main base plate 150 extending generally across the front to the rear of the coiler and provides means for integrally attaching an entrance plate 152 and an exit ramp 154. Base plate 150 includes a plurality of pins 156. Entrance plate 152 may be made integral with base plate 150 by inserting pins 156 through holes 158 formed in a block 160 which is one piece with entrance plate 152. Entrance plate 152 and base plate 150 are made integral by welding of the pins. However, ramp 154 is not welded to pins 158 as it is desired to remove ramp plate 154 when pivoting the coiler. Spaced above base plate 150 is a top base plate 150a which is supported by a tube frame 162. Coiler can turntable 164 is flush mounted in top plate 150a. In use, coiler cans are automatically fed from the entrance plate 152 to the coiler turntable 164 and off of ramp plate 154 in an automatic manner. There is a coiler tower 166 integral with top base plate 150a. Upper housing 60 is carried atop tower 166 extending to a post 170. Coiler head 172 is carried by tower 166.

Referring now in more detail to coiler connecting means H, as can best be seen in FIG. 4, there is a bracket 174 bolted to front box frame member 66. There is a pivot pin 176 on bracket 174 over which a pivot plate 178 is carried. Pivot plate 178 is bolted onto a plate 180 welding in a corner of platform housing 182 which is integral with entrance plate 152. Platform housing 182 includes a platform 184 which is used for tending the machine when operating. Affixed to front box frame 66 is a plate 186 having a clamp plate 188 affixed thereto such as by welding. There is a bottom clamp plate 190. Clamp plate 188 extends through forklift opening 84. Clamp plate 190 extends underneath forklift opening 84. Bolts are used to clamp the clamping plates 188 and 190 together so that box frame 66 and beam 82 of carding machine frame 54 are fixed together. In this manner, coiler connecting means H affixes the coiler frame to the carding frame.

There is an alignment means for insuring that the coiler is returned into sliver receiving alignment with carding machine A. This alignment means both aligns the coiler and locks it into an aligned position. As illustrated, alignment means comprises a plate 192 bolted to box frame 65 having a cantilevered arm 194 with a threaded end which is inserted between the arms of a fork plate 196 when the coiler is brought into alignment. The threaded end may be locked onto forked alignment plate 196 by a nut 198. Pivotal coiler connecting means H and alignment arm 94 together insure that the coiler is moved away and back to sliver receiving alignment with carding machine A when moved.

Coiler rollers means are illustrated at 200 for moving the coiler, which can weigh upwards to three thousand pounds. The coiler roller means include vertically adjustable bolts 202 which position the rollers through openings 204 in base plate 150. The rollers may be extended so that coiler frame F rests on its base or on suitable foot rests 206. In an extended position, rollers 200 pass through the openings 204 and raise coiler frame F on pivot pin 176 while still maintaining the pivot connection. When sufficiently extended, coiler B may then be pivoted after it is unlocked from nut 198 to the dotted line portion shown in FIG. 5. Also pins 156 of ramp 154 must be removed so that the ramp is not moved. Rollers 200 are mounted in tower 166 by threaded welded blocks 208. Rollers 200 adjacent the carding machine are likewise mounted to post 170 by threaded welded blocks 208.

Thus, it can be seen that a highly advantageous construction can be had for integrated frames of an associated chute feed, carding machine, and coiler, particularly for a compact carding arrangement where carding cylinders are mounted vertically. The associated chute feed and coiler may be moved away from the compact carding machine arrangement for access to either machine and then returned to its proper operational position relative to the carding machine.

While a preferred embodiment of the invention has been described using specific terms, such description is for illustrative purposes only, and it is to be understood that changes and variations may be made without departing from the spirit or scope of the following claims.

What is claimed is:

1. Textile carding apparatus of the type which includes a carding machine having a first carding cylinder assembly and a second carding cylinder assembly with respective first and second clothed carding cylinders arranged in fiber transfer relation, carding means carried about the carding cylinders for subjecting fibers on said cylinders to a carding action; fiber feed means for feeding fibers to a first of said cylinders; fiber doffing means for doffing fibers from a second of said cylinders and forming a web; means for condensing the web into a sliver, and a textile coiler having a coiler can in which said sliver is deposited; wherein said apparatus includes integrated frame apparatus which comprises:

(a) carding frame means including a card frame for carrying said first and second carding cylinders in a generally upstanding arrangement one above the other;

(b) a chute frame for carrying said fiber feed chute in a fiber supply relation to said fiber feed means of said carding machine;

(c) coiler frame means for carrying said coiler in alignment with said carding machine for depositing said sliver in a coiler can;

(d) chute connecting means connecting said chute frame to said carding frame in a movable manner so that said chute frame and feed chute may be moved away from said carding machine while remaining connected to said carding frame means for access to a first side of said carding machine; and (e) coiler connecting means connecting said coiler frame means to said carding frame means in an aligned movable manner so that said coiler may be moved away from said carding machine while remaining connected to said carding machine to permit access to a second opposite side of said carding machine and coiler, and may be returned to an aligned position where said coiler is in alignment for receiving and depositing sliver from said carding machine.

2. The apparatus of claim 1, wherein said chute connecting means includes track means for slidably connecting said chute frame and carding frame means together for relative horizontal movement.

3. The apparatus of claim 2, wherein said track means includes horizontal track means carried by said carding frame means and said chute frame comprises longitudinal members which move in guiding relation with said horizontal track means during movement of said chute feed.

4. The apparatus of claim 2, wherein said chute frame comprises adjustable chute rollers carried adjacent a backside of said chute frame having an extended position for moving said feed chute and a retracted position for positioning said chute frame on a frame rest.

5. The apparatus of claim 4, wherein said frame rest includes a plurality of foot rests for supporting said chute frame when said rollers are in said retracted position.

6. The apparatus of claim 4, wherein said chute connecting means includes horizontal track means interconnecting said chute frame and said carding frame means facilitating said horizontal movement.

7. The apparatus of claim 6 including lock means for locking said chute frame in a desired horizontal position relative to said carding frame means in working relationship with said carding machine.

8. The apparatus of claim 1, wherein said coiler connecting means includes pivot means connecting said coiler frame means and said carding frame means so that said coiler frame means and coiler may be moved away from said carding apparatus in a pivotal movement anchored and guided by said carding frame means.

9. The apparatus of claim 8, wherein said coiler frame means comprises a coiler base plate and carries vertically adjustable coiler roller means which may be extended through said base plate to provide rolling of said coiler frame means and having a retracted position at which said coiler frame means is supported on a base rest.

10. The apparatus of claim 8 including alignment means for guiding said coiler frame means during pivotal movement and locking said coiler in said aligned position.

11. The apparatus of claim 1, wherein said carding frame means comprises:

a base;

a plurality of standards carrying said first carding cylinder on said base; and mounting means supporting said second carding cylinder on said first carding cylinder in a manner that said base means provides a generally self-standing support for said first and second carding cylinders.

12. The apparatus of claim 11 including a pair of first support arms carried by said first cylinder assembly for supporting said fiber feed means.

13. The apparatus of claim 12 including a pair of second support arms carried by said second cylinder assembly for supporting said fiber doffing means.

14. The apparatus of claim 13, wherein said first carding cylinder is carried below said second carding cylinder.

15. Textile carding apparatus of the type which includes a carding machine having a first carding cylinder assembly and a second carding cylinder assembly with respective first and second clothed carding cylinders arranged in fiber transfer relation, carding means carried about the carding cylinders for subjecting fibers on said cylinders to a carding action; fiber feed means for feeding fibers to a first of said cylinders; fiber doffing means for doffing fibers from a second of said cylinders and forming a web; means for condensing the web into a sliver, and a textile coiler having a coiler can in which said sliver is deposited; wherein said apparatus comprises:

(a) base means for supporting said first and second carding cylinder assemblies in a generally upstanding arrangement in a self-standing manner;

(b) said first carding cylinder being rotatably carried by said base means;

(c) mounting means for carrying said second carding cylinder assembly generally above said first carding cylinder assembly;

(d) first support arm means carried by one of said first and second cylinder assemblies for supporting a fiber feed means feeding fibers to said one cylinder assembly; and (e) second support arm means carried by the other of said first and second cylinder assemblies for supporting a fiber doffing means for removing fibers from said other cylinder assembly.

16. The apparatus of claim 15, wherein said mounting means comprises means for mounting said second cylinder to move radially away from said first carding cylinder for yielding to the passage of a large lump between said first and second carding cylinders.

17. The apparatus of claim 16 wherein said mounting means comprises:

(a) first plates rigidly affixed to said first cylinder assembly and second plates rigidly affixed to said second cylinder assembly;

(b) said first and second plates being carried for movement in said radial direction relative to each other; and (c) yieldable attachment means for attaching said first plates to said second cylinder assembly and said second plates to said first cylinder assembly, which yield to radial forces from said lumps in such a manner to permit a limited relative movement in said radial direction between said cylinders of said first and second cylinder assemblies.

18. The apparatus of claim 16 wherein said mounting means includes:

(a) a set means for setting a clearance between said first and second cylinder assemblies; and (b) said set means preventing movement of said second cylinder assembly towards said first cylinder assembly once said clearance has been set while permitting said relative radial movement between said first and second plates to allow movement of said second cylinder assembly away from said first cylinder assembly.

19. The apparatus of claim 16 including lock means for locking said chute frame in a desired horizontal position relative to said carding frame so that said chute feed is in a working relationship with said carding machine.

20. The apparatus of claim 15, wherein said base means comprises a base having spaced sides; a pair of standards extending from said sides of said base upwardly and connected to said first cylinder assembly supporting said first and second cylinder assemblies in a self-standing manner.

21. The apparatus of claim 20 wherein said base means comprises forklift openings in which a forklift may be inserted for moving said base means.

22. The apparatus of claim 15 including girth beam bridging said second cylinder assembly for holding end shrouds of said second cylinder assembly together.

23. The apparatus of claim 15 wherein said first support arm means comprises a pair of spaced cantilevered arms extending outwardly from said first cylinder assembly, and said second support arm means includes a pair of spaced cantilevered arms extending outwardly from said second carding cylinder assembly in a manner that said fiber feeding means and fiber doffing means are supported from said carding cylinder assemblies.

24. Textile carding apparatus of the type which includes a carding machine having at least one carding cylinder assembly with a clothed carding cylinder, carding means carried about the carding cylinder for subjecting fibers on said cylinders to a carding action; fiber feed means for feeding fibers to said cylinder; fiber doffing means for doffing fibers and forming a web; means for condensing the web into a sliver, and a textile coiler having a coiler can in which said sliver is deposited; wherein said apparatus includes integrated frame apparatus comprising:

(a) a carding frame for carrying said carding cylinder assembly;

(b) a chute frame for carrying said fiber feed chute in a fiber supply relation to said fiber feed means of said carding machine; and (c) chute connecting means connecting said chute frame to said carding frame in a movable manner so that said chute frame and feed chute may be moved away from said carding machine while remaining connected to said carding frame and returned to an operational position.

25. The apparatus of claim 24, wherein said chute connecting means includes track means for slidably connecting said chute frame and carding frame together for relative horizontal movement.

26. The apparatus of claim 25, wherein said track means includes horizontal track means carried by said carding frame and said chute frame comprises longitudinal members which move in guiding relation with said horizontal track means during movement of said chute feed.

27. The apparatus of claim 25, wherein said chute frame comprises adjustable chute rollers carried adjacent a backside of said chute frame having an extended position for moving said chute frame and a retracted position for positioning said chute frame on a frame rest.

28. The apparatus of claim 27, wherein said frame rest includes a plurality of adjustable foot rests for supporting said chute frame means when said rollers are in said retracted position.

29. The apparatus of claim 27 including roller drive means for driving said chute rollers in rotation.

30. The apparatus of claim 29 wherein said horizontal track includes hollow horizontal legs carried by said base means in which said telescoping longitudinal members of said chute frame are received.

31. The apparatus of claim 30, wherein said chute connecting means includes a horizontal track carried by said carding frame and telescoping horizontal legs carried by said chute frame received on said horizontal track.

32. The apparatus of claim 27, wherein said drive means comprises a common drive shaft affixed to said rollers having a drive end for being driven by a ratchet type wrench to manually rotate said chute rollers.

33. The apparatus of claim 24 including coiler frame means for carrying said coiler in a sliver depositing relation with said carding machine; and coiler connecting means connecting said coiler frame means to said carding frame means in a movable manner so that said coiler may be moved away from said carding machine while still connected to said carding machine to permit access to one side of said carding machine and said coiler.

34. The apparatus of claim 33, wherein said coiler connecting means includes pivot means connected to said coiler frame means and said carding frame means so that coiler may be moved away from said carding machine in a pivotal movement anchored by said carding frame means; and said coiler frame means comprises vertically adjustable roller means which may be extended to provide rolling of said coiler frame means and having a retracted position which said coiler frame means is supported on a base.

35. Textile carding apparatus of the type which includes a carding machine having a first carding cylinder assembly and a second carding cylinder assembly with respective first and second clothed carding cylinders arranged in fiber transfer relation, carding means carried about the carding cylinders for subjecting fibers on said cylinders to a carding action; fiber feed means for feeding fibers to a first of said cylinders; fiber doffing means for doffing fibers from a second of said cylinders and forming a web; means for condensing the web into a sliver, and a textile coiler having a coiler can in which said sliver is deposited; wherein said apparatus comprises:

(a) carding frame means including a card frame for carrying said carding cylinder;

(b) coiler frame means for carrying said coiler in a sliver depositing relation with said carding machine; and (c) coiler connecting means connecting said coiler frame means to said carding frame means in a movable manner so that said coiler may be moved away from said carding machine while remaining connected to said carding machine to permit access to one side of said carding machine and said coiler and return to an operational position.

36. The apparatus of claim 35, wherein said coiler connecting means includes pivot means connected to said coiler frame means and said carding frame means so that coiler may be moved away from said carding machine in a pivotal movement anchored by said carding frame means.

37. The apparatus of claim 36, wherein said coiler frame means comprises vertically adjustable roller means which may be extended to provide rolling of said coiler frame means and having a retracted position which said coiler frame means is supported on a base.

38. The apparatus of claim 36 including alignment means for guiding said coiler frame means during a return pivotal movement to an aligned working position in which said coiler and carding machine are accurately aligned for sliver delivery and depositing by said coiler.

39. The apparatus of claim 38 wherein said alignment means includes lock means for aligning and locking said coiler into said alignment working position.

* * * * *